United States Patent [19]

Paul et al.

[11] Patent Number: 4,633,661

[45] Date of Patent: Jan. 6, 1987

[54] RETHREADING ARRANGEMENT FOR FRICTION FALSE-TWISTING UNIT FOR TEXTILE THREADS

[75] Inventors: Gunther Paul, Hammelburg; Kirit Patel, deceased, late of Elfershausen, both of Fed. Rep. of Germany, by Shakuntala Patel, heiress

[73] Assignee: FAG Kugelfischer Georg Schafer (KGaA), Fed. Rep. of Germany

[21] Appl. No.: 738,045

[22] Filed: May 24, 1985

[30] Foreign Application Priority Data

May 25, 1984 [DE] Fed. Rep. of Germany ..... 3419483

[51] Int. Cl.[4] ..... D01H 15/00; D01H 1/241; D01H 7/22; D02G 1/08

[52] U.S. Cl. ..... 57/280; 57/88; 57/340; 57/348

[58] Field of Search ..... 57/279, 280, 105, 338–340, 57/348, 88, 352, 104

[56] References Cited

U.S. PATENT DOCUMENTS

| | | | |
|---|---|---|---|
| 4,226,080 | 10/1980 | Bieber et al. | 57/280 X |
| 4,235,071 | 11/1980 | Dillon | 57/280 |
| 4,325,213 | 4/1982 | Adenheuer | 57/280 |
| 4,442,664 | 4/1984 | Schmitt et al. | 57/280 X |
| 4,485,617 | 12/1984 | Schmitt et al. | 57/280 X |

FOREIGN PATENT DOCUMENTS

| | | |
|---|---|---|
| 1510711 | 3/1971 | Fed. Rep. of Germany . |
| 3121614 | 1/1984 | Fed. Rep. of Germany . |
| 2935380 | 4/1984 | Fed. Rep. of Germany . |

OTHER PUBLICATIONS

Leimer, Rollo M., "Wear-Resistant Coatings: Their Evolution as Fiber Contact Surfaces", Oct. 1980, Fiber Producer.

Sharp, William F., "Properties and Applications of Composite Diamond Coatings", 1974, Proceedings Diamond-Partner in Productivity 1974, pp. 121–126.

*Primary Examiner*—John Petrakes

*Attorney, Agent, or Firm*—Ostrolenk, Faber, Gerb & Soffen

[57] ABSTRACT

In a friction false-twisting unit including three parallel spindles supported on a mount and each spindle carrying a stack of friction disks and the friction disks of the various spindles being interleaved, the thread to be threaded into the unit passing from an upper thread guide above the ends of the spindles, over a thread guide arm which holds the thread away from contact with the disks, and to a feeder system below the other end of the spindles. A support lever is movable between an operative position which holds the drive whorl for the spindles in contact with an operating belt and an inoperative position at which the spindle mount is moved to separate the drive whorl from the belt. The thread guide arm is on the support lever to be moved to the position holding the thread away from the disk when the support lever is moved to the inoperative position of the unit. The thread guide arm is comprised of or coated with a material which permits the thread to rub over the thread guide arm without damage to either the thread guide arm or to the thread.

12 Claims, 3 Drawing Figures

RETHREADING ARRANGEMENT FOR FRICTION FALSE-TWISTING UNIT FOR TEXTILE THREADS

BACKGROUND OF THE INVENTION

The present invention relates to a friction false-twisting unit, and more particularly to the thread guide used in rethreading the false-twisting unit.

Known friction false-twisting units of this kind are shown, for instance, in Federal Republic of Germany Pat. Nos. 31 21 614 and 29 35 380. The latter patent shows a mobile threader for the introduction of thread into a false-twisting unit. In Federal Republic of Germany Pat. No. 15 10 711, a support mount is shown having a disengagement lever for engaging and disengaging the spindles of the unit from the drive belt. This support mount is also frequently used for friction false-twisting units.

Normally, friction false-twisting units, whether they have friction disks of hard or of soft material, are disconnected during the threading process while the thread feed and the feeder system remain in operation. Before the thread is inserted into the unit and over the disks, and particularly in the case of mobile threading, the thread is introduced into the feeder system. This involves taking the thread from a thread guide above one end of the spindles, moving it past the unit and installing it on a thread feeder system below the other end of the spindles. Operators frequently forget to disconnect the units, so that the disks continue to turn during the threading process.

During placing of a thread on the feeder system, a so-called loose thread is necessarily produced on the side that is toward the friction false-twisting unit. If the friction disks of the unit are alrady rotating, the loose hanging thread is grasped by the disks and is pulled into the unit. In this way, within a short time, wrappings are produced, which form around the neck between the disks. These wrappings are very difficult and time-consuming to remove. The consequence is long standstill times and thus a drop in production.

SUMMARY OF THE INVENTION

The object of the present invention is, therefore, to create an economically feasible, uncomplicated device, which can be retrofitted and which eliminates the defects indicated.

Another object is to provide a device which permits threading of the thread to the thread feed mechanism and past the disks of the unit without undesirable contact of the thread with the friction disks.

The present invention concerns an improvement upon a known friction false-twisting unit. Such a unit is comprised of three parallel shafts or spindles which are driven to rotate together by belts. Each spindle carries at least one and more usually a stack of friction disks. The spindles are so arranged and the disks are so sized that disks on the different shafts are interleaved alternatingly. The thread passes axially along the disks, and the rotating disks texture the thread. All of the spindles are disposed on a mount. One of the spindles extends to a drive whorl which is in communication with a drive belt. Means associated with the drive whorl, and/or with the mount for all of the spindles, and/or with the drive belt is operable for moving the respective element with which it is associated selectively to separate the drive whorl from the common drive belt or to move them into engagement. A support lever communicates with the movable one of those elements for separating or for moving the belt and drive whorl together. For example, the support lever communicates with the mount for all of the shafts. The support lever is movable between a down position, which is an operating position for permitting the drive whorl and the belt to come into engagement for rotating the drive whorl, and an up, outwardly extended position at which the drive whorl and the belt are separated.

The primary feature of the invention lies in the thread guide arm over which the thread is passed from an upper thread guide to the feeder system past the friction false-twisting unit and over which the feeder system draws the thread past the false-twisting unit.

The device of the invention is formed of a thread guide arm which is fastened, by an attachment element, to the already present support lever of the unit support mount. The thread guide arm is developed so that during the drive whorl disengagement phase, the thread guide arm extends laterally beyond the unit via the support lever, toward the operator's side. As a result, the attention of the operator is necesarily directed to the fact that the unit is disengaged. The thread is now inserted into the upper stationary ring thread guide and is moved toward the front into the thread loop guide, which is arranged on the thread guide arm. The thread can now be extended to and placed on the feeder system without undesirable disk contact. The drive whorl of the unit is then moved against the drive belt by swinging the support lever downward. The thread guide arm also moves downward and releases the thread, and the thread can thereafter be inserted into the disks of the unit with a mobile threader. The thread guide arm, at least where thread rubs over that arm, is either comprised of or coated with material which does not damage the thread and is not damaged by it.

Another advantage of the device is that the thread, which is already traveling, cannot injure the disks, particularly in the case of units provided with disks of soft material.

Other objects and features of the invention are described below with reference to the accompanying drawings.

DESCRIPTION OF THE PREFERRED EMBODIMENTS

Figure 1:
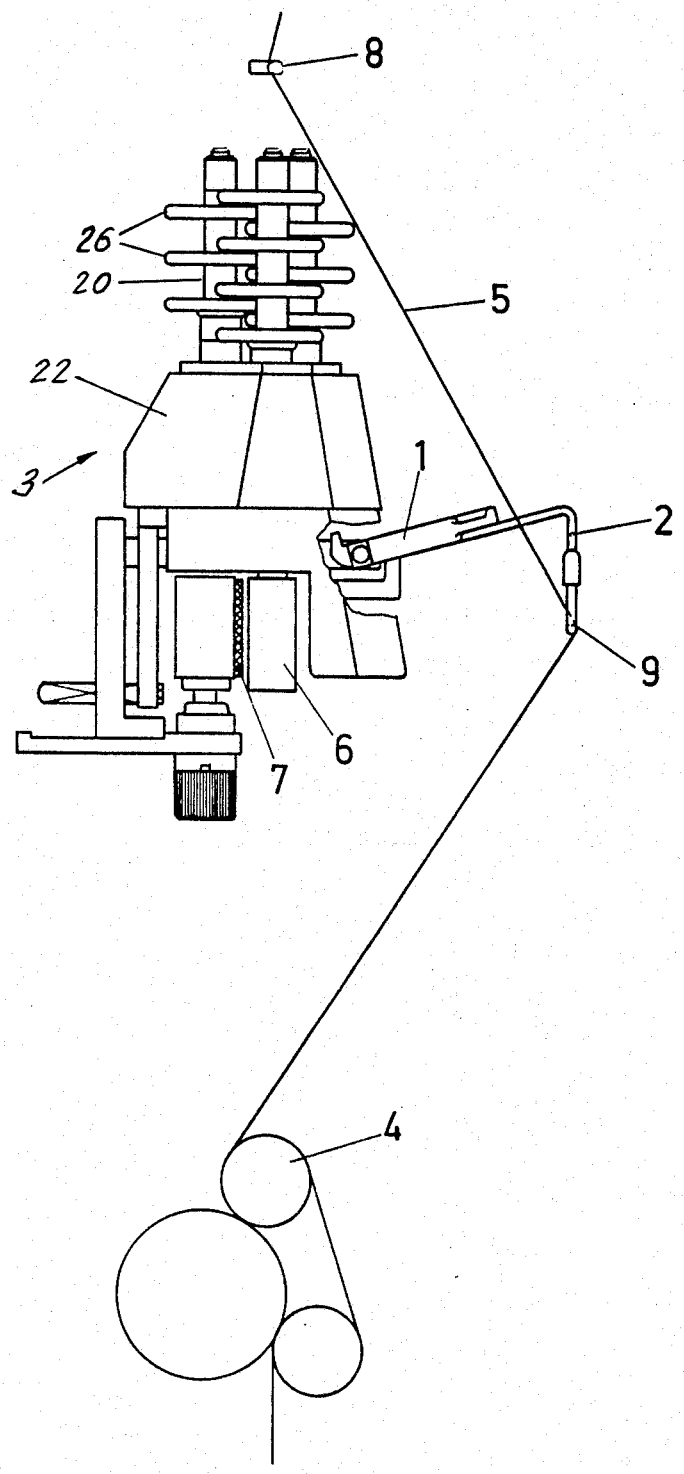
FIG. 1 is a side view of a false-twisting unit, with the thread, which is away from the unit, inserted into the thread guide arm.

A typical friction false-twisting unit, shown in U.S. Pat. Nos. 4,068,460, or 4,015,414 and application Ser. No. 552,282, filed Nov. 16, 1983, now U.S. Pat. No. 4,566,262, for example, comprises three parallel, upstanding rotatable shafts 20 which are placed to define the corners of an equilateral triangle. The shafts project up from a common mount. A drive means inside the housing 22 causes the shafts to all rotate, as is known. Each of the shafts carries a stack of spaced disks 26, which are sized to be interleaved with the disks on the other shafts 20. Each of the disks has a surface which rubs a yarn thread that is moved past the disks in the axial direction of the shafts, and the thread passes through along the center of the triangle of shafts.

One of the shafts is elongated below the mount for the shafts and there carries a friction drive whorl 6. The whorl is rubbed generally tangentially over its surface by a drive belt 7 which rotates the drive whorl. The shafts 20 are also interconnected to rotate together. The shafts are mounted on a common support or plate, and that can be rotated or moved, as described below, to selectively drive or stop driving the shafts to rotate.

In FIG. 1, the false-twisting unit 3 is shown in disengaged position. There is a support lever 1 which is connected to the common mount for the shafts, or to the drive whorl 6 or which includes means that shift the drive belt 7, such that upon movement of the lever 1 upwardly, the drive whorl and the drive belt are separated, while upon movement of the lever 1 downwardly, the drive whorl and belt are brought together.

There is also a thread guide arm 2 which is attached on the support lever 1 and swings along with the lever 1. The guide arm is of a length to project outward from the unit 1 beyond the lever 1.

When the support lever 1 is swung upward, the common mount, the drive whorl 6 and/or the belt 7 is moved so that the whorl no longer contacts the tangential belt 7. The thread guide arm 2 is also moved upwardly with the support lever 1. The thread 5, now completely free of the unit 3, is passed down through the upper thread guide ring 8 and is guided in the loop 9 of the upraised thread guide arm 2. Loop 9, as can be seen from FIG. 3, is a simple fold in the lever 2. When the lever 2 is upward, projecting out from the unit, as in FIG. 1, the thread is also held out from the unit and in the loop. The thread is fed past the lever 2 to the thread feeder system 4. The thread can then be brought onto the feeder system 4 for the yarn without interference from the false-twisting unit 3. With the lever 2 and loop 9 down as in FIG. 2, the thread simply falls free of the loop 9 and lever 2 and can be threaded into the unit 3 in a conventional manner.

Figure 2:
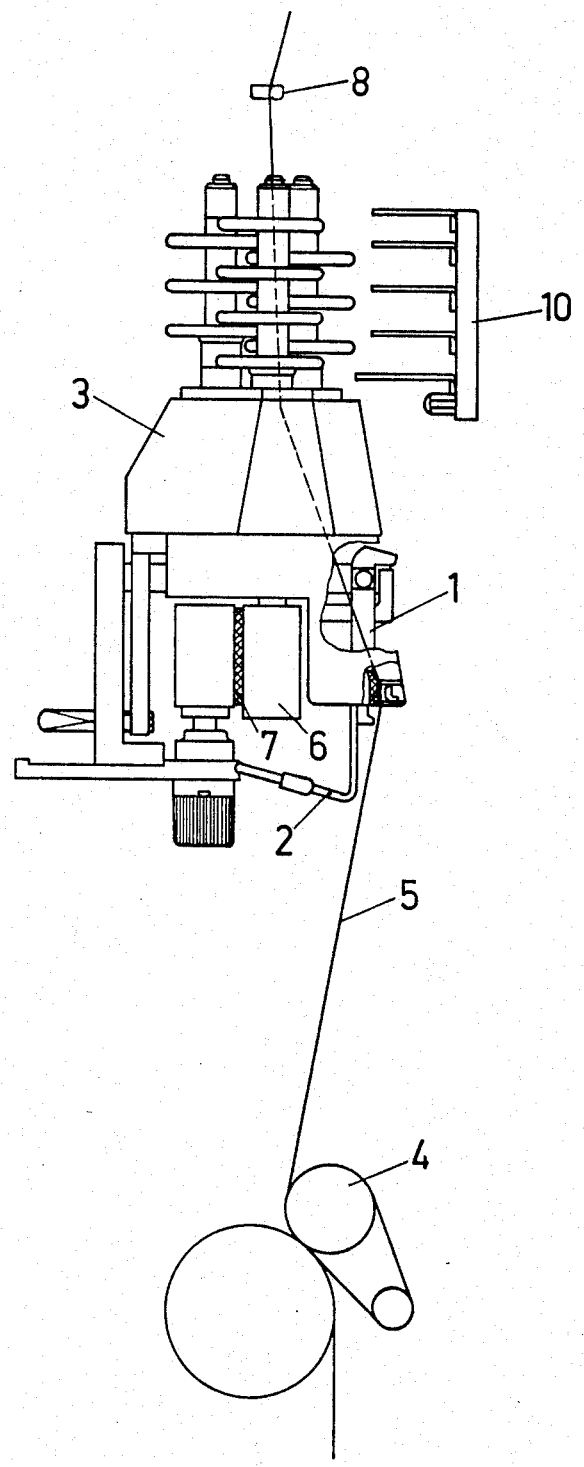
FIG. 2 is a side view of the false-twisting unit in which the thread has been already inserted by means of a threader and the thread guide arm has been swung downward.
Figure 3:
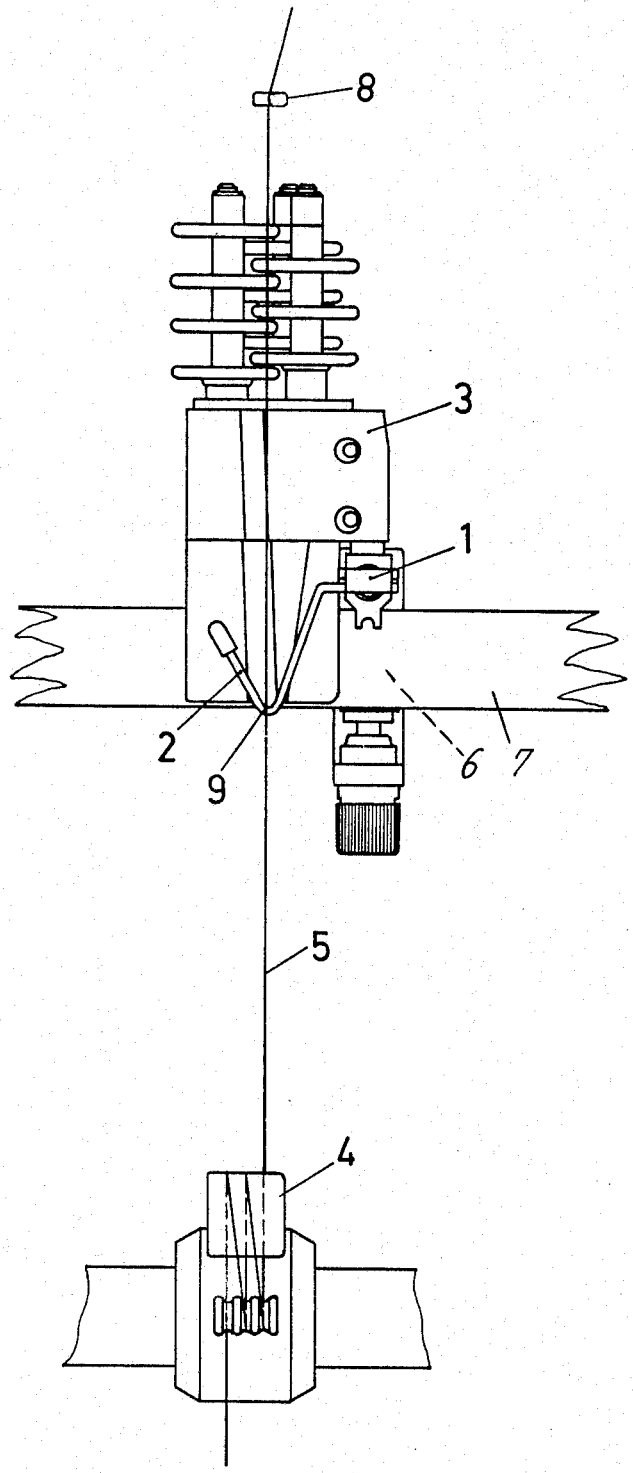
FIG. 3 is a front view of the false-twisting unit during the threading process.

FIG. 2 also shows the same false-twisting unit 3 in side view, but in its engaged position. The support lever 1 is swung downward, causing the drive whorl 6 to lie against the tangential belt 7. The thread guide arm 2 has been swung downward by the lever 1. This motion causes release of the thread 5. The thread 5, which is now connected to the feeder system, is placed into the unit 3 by the known mobile threader 10, whereby the thread may pass through the region between the shafts 20.

FIG. 3 shows the false-twisting unit 3 in front view, with the feeder system 4 already threaded. The support lever 1 and thus also the thread guide arm 2 are shown swung upward. The thread 5 lies in the loop 9 of the thread guide arm and in the upper thread guide 8.

The thread rubs the arm 2 at the loop 9. To protect the arm from wearing and to prevent tearing or snagging of the thread, the arm 2, at least at the loop 9, is coated with or may itself even be comprised of an appropriate material. Choices include a steel arm, provided with a hard chromium coating; or an arm which is coated by plasma spraying; or an arm that is Ni-Di (nickel-diamond) coated; or an arm that consists of or that is coated with a smooth ceramic material.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A friction false-twisting unit for false-twisting textile threads, the unit comprising:

a mount for rotatable spindles; a support for the mount; three spindles projecting up from the mount and generally parallel to each other; a drive whorl on one of the spindles for engaging a drive belt for being driven to rotate, and the spindles being interconnected for rotation together; at least one respective friction disk on each of the spindles and rotatable therewith; the spindles being so placed and the friction disks being so sized that the disks on all three spindles are interleaved;

a support lever connected with at least one of the belt, the drive whorl and the mount for the spindles; the support lever having an operative position at which it causes the drive whorl and the belt to be in engagement for the belt to drive the whorl, and an inoperative position at which the support lever causes the belt and the drive whorl to be separated so that the belt does not drive the whorl to rotate; and a thread guide arm connected to the support lever and movable therewith between the operative and inoperative positions of the support lever; the thread guide arm being so shaped that a thread passed over the thread guide arm when the support lever is in the inoperative position is held away from the disks and thereby is held away from contacting the disks; the thread guide arm also being shaped and positioned such that when the support lever is in the operative position, the thread guide arm is disposed where it will permit the thread to be moved into contact with the disks.

2. The friction false-twisting unit of claim 1, further comprising a thread guide located beyond one longitudinal end of the spindles and a thread feeder system located beyond the other ends of the spindles, the thread guide and the feeder system being so disposed that a thread extending from one toward the other will normally contact the friction disks; and the thread guide arm, in the inoperative position of the support lever, being shaped and positioned to hold a thread extending from the thread guide to the feeder system out of contact with the disks.

3. The friction false-twisting unit of claim 2, wherein the spindles are so placed that they define the corners of an equilateral triangle.

4. The friction false-twisting unit of claim 2, wherein the mount is movable between a spindle operative and spindle non-operative orientation.

5. The friction false-twisting unit of claim 4, wherein the support lever is connected with the spindle mount for moving the spindle mount to move the drive whorl into and out of engagement with the drive belt for respectively driving and halting the driving of the whorl.

6. The friction false-twisting unit of claim 2, wherein the thread guide arm includes engageable means thereon which is engaged by and passed over by a thread when the thread guide arm is in the inoperative position of the support lever.

7. The friction false-twisting unit of claim 6, wherein the engageable means for supporting the thread on the thread guide arm comprises a loop in the thread guide arm which engages and supports the thread when the thread guide arm is in the inoperative position of the support lever and which disengages from the thread when the thread support lever is in the operative position thereof.

8. The friction false-twisting unit of claim 6, wherein the thread guide arm engageable means comprises steel provided with a chromium coating.

9. The friction false-twisting unit of claim 6, wherein the thread guide arm engageable means is plasma coated.

10. The friction false-twisting unit of claim 6, wherein the thread guide arm engageable means is Ni-Di coated.

11. The friction false-twisting unit of claim 6, wherein the thread guide arm engageable means is comprised of a ceramic material.

12. A method of threading a length of thread into a friction false-twisting unit, wherein the unit comprises three parallel spindles, each carrying at least one friction disk and the friction disks being interleaved; the method comprising threading the thread past an upper thread guide above one end of the spindles, passing the thread past the spindles and passing the thread to a feeder system below the other end of the spindles;

separating the spindles from a means for driving the spindles and at the same time raising a thread guide arm outwardly of the spindles; the thread guide arm and the spindles being interconnected for causing said separating thereof to occur at the same time as said outward movement; the thread guide arm moving outwardly sufficiently that thread passed from the upper thread guide to the feeder system and past the thread guide arm is held out of contact with the disks; threading the thread from the upper thread guide, over and past the thread guide arm and to the feeder system and thereafter feeding the thread to the feeder system; and moving the thread guide arm away from the position of holding the thread out from the disks, for enabling the thread to be moved in toward the disks, and separating the thread guide arm from the thread; and inserting the thread into the interleaved disks for causing the thread to be acted upon by all of the disks past which the thread is moved by the feeder system; wherein moving the thread guide arm away from said outward position causes the spindles to be drivingly engaged with the means for driving the spindles.

* * * * *